US009349319B2

(12) United States Patent
Wu et al.

(10) Patent No.: US 9,349,319 B2
(45) Date of Patent: May 24, 2016

(54) AMOLED DRIVING CIRCUIT, AMOLED DRIVING METHOD, AND AMOLED DISPLAY DEVICE

(71) Applicants: BOE TECHNOLOGY GROUP CO., LTD., Beijing (CN); CHENGDU BOE OPTOELECTRONICS TECHNOLOGY CO., LTD., Beijing (CN)

(72) Inventors: Bo Wu, Beijing (CN); Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 82 days.

(21) Appl. No.: 14/127,733

(22) PCT Filed: Nov. 2, 2012

(86) PCT No.: PCT/CN2012/084024

§ 371 (c)(1),
(2) Date: Dec. 19, 2013

(87) PCT Pub. No.: WO2013/139127

PCT Pub. Date: Sep. 26, 2013

(65) Prior Publication Data

US 2014/0111562 A1 Apr. 24, 2014

(30) Foreign Application Priority Data

Mar. 19, 2012 (CN) ..... 2012 1 0073165

(51) Int. Cl.
*G09G 3/32* (2006.01)

(52) U.S. Cl.
CPC ..... *G09G 3/3233* (2013.01); *G09G 2300/0819* (2013.01); *G09G 2300/0842* (2013.01);
(Continued)

(58) Field of Classification Search
CPC ..... G09G 3/3233; G09G 3/325
See application file for complete search history.

(56) References Cited

U.S. PATENT DOCUMENTS

2005/0243036 A1 11/2005 Ikeda
2005/0258775 A1 11/2005 Ikeda (Continued)

FOREIGN PATENT DOCUMENTS

CN 1684558 A 10/2005
CN 1700283 A 11/2005

(Continued)

OTHER PUBLICATIONS

International Search Report mailed Feb. 14, 2013; PCT/CN2012/084024.

(Continued)

*Primary Examiner* — Dwayne Bost
*Assistant Examiner* — Sepehr Azari
(74) *Attorney, Agent, or Firm* — Ladas & Parry LLP

(57) ABSTRACT

In embodiments of the present disclosure, there are provided an AMOLED driving circuit, an AMOLED driving method and an AMOLED display device. The AMOLED driving circuit includes a light emitting device, a first switching transistor, a voltage regulator, a driving transistor and a capacitor. The driving transistor in the AMOLED driving circuit drives the light emitting device to emit light under the control of the voltage regulator, a driving current provided by the driving transistor is independent of Vth of the driving transistor, so that the driving current flowing through the light emitting device is prevented from being affected by the poor uniformity and drift of Vth, the uniformity in the driving currents flowing through the light emitting devices is enhanced, and thus the uniformity in the brightness of the AMOLED is improved.

6 Claims, 6 Drawing Sheets

(52) U.S. Cl.
CPC ..... *G09G2300/0861* (2013.01); *G09G 2310/0251* (2013.01); *G09G 2310/0262* (2013.01); *G09G 2320/045* (2013.01)

(56) References Cited

U.S. PATENT DOCUMENTS

| | | | | |
|---|---|---|---|---|
| 2006/0077194 | A1* | 4/2006 | Jeong | 345/204 |
| 2007/0126680 | A1* | 6/2007 | Han et al. | 345/92 |
| 2011/0050659 | A1* | 3/2011 | Tsai et al. | 345/205 |
| 2011/0267319 | A1 | 11/2011 | Han | |

FOREIGN PATENT DOCUMENTS

| | | | |
|---|---|---|---|
| CN | 101609839 | A | 12/2009 |
| CN | 101859536 | A | 10/2010 |
| CN | 101996579 | A | 3/2011 |
| CN | 102651198 | A | 8/2012 |

OTHER PUBLICATIONS

International Preliminary Report on Patentability Appln. No. PCT/CN2012/084024.

First Chinese Office Action dated Nov. 5, 2013; Appln. No. 201210073165.2.

Second Chinese Office Action dated Jun. 19, 2014; Appln. No. 201210073165.2.

* cited by examiner

AMOLED display device

AMOLED DRIVING CIRCUIT, AMOLED DRIVING METHOD, AND AMOLED DISPLAY DEVICE

TECHNICAL FIELD

Embodiments of the present disclosure relate to a field of display technique, and in particular to an AMOLED driving circuit, an AMOLED driving method and an AMOLED display device.

BACKGROUND

With development of the display technique, the application of an Active Matrix Organic Light Emitting Diode panel (referred to as AMOLED hereinafter) called as a next generation display technique becomes more and more important. Light emitting devices in the AMOLED are Organic Light-Emitting Diodes (referred to as OLEDs hereinafter), and a light emitting device OLED emits light when a current flows through the OLED under the control of an AMOLED light emitting device.

Currently, the AMOLED driving circuit generally utilizes a traditional 2T1C circuit comprising two thin film transistors (referred to as TFT hereinafter) and one capacitor. In general, the AMOLED driving circuit is manufactured by a Low Temperature Poly-silicon (referred to as LTPS hereinafter) technique, but threshold voltages Vth of TFTs manufactured by the LTPS technique have a poor uniformity and may have drifts. Because of the poor uniformity and drifts of the threshold voltages Vth of TFTs, driving currents flowing through OLEDs are non-uniform, such that the uniformity in brightness of the AMOLED is decreased.

SUMMARY

In embodiments of the present disclosure, there are provided an AMOLED driving circuit, an AMOLED driving method and an AMOLED display device, which may improve the uniformity in driving currents flowing through the light emitting devices and in turn improve the uniformity in brightness of the AMOLED.

In view of this, in the embodiments of the present disclosure, there is provided an AMOLED driving circuit, comprising: a light emitting device, a first switching transistor, a voltage regulator, a driving transistor and a capacitor;

a gate of the first switching transistor is connected with a first control line, a first electrode of the first switching transistor is connected with a data line, and a second electrode of the first switching transistor is connected with the voltage regulator and a first terminal of the capacitor;

a first electrode of the driving transistor is connected with the voltage regulator and a second terminal of the capacitor, a second electrode of the driving transistor is connected with a first electrode of the light emitting device, and a gate of the driving transistor is connected with the voltage regulator;

a second electrode of the light emitting device is connected with a second power supply;

the voltage regulator is connected with the first control line, a second control line and a first power supply.

In an embodiment, the voltage regulator comprises a second switching transistor, a third switching transistor and a fifth switching transistor;

the second electrode of the first switching transistor is connected with a first electrode of the second switching transistor, the second electrode of the first switching transistor is connected with the first terminal of the capacitor;

a gate of the second switching transistor is connected with the second control line and a gate of the fifth switching transistor, the first electrode of the second switching transistor is connected with the first terminal of the capacitor, the second electrode of the second switching transistor is connected with a first electrode of the third switching transistor and the gate of the driving transistor;

a gate of the third switching transistor is connected with the first control line, a first electrode of the third switching transistor is connected with the gate of the driving transistor, a second electrode of the third switching transistor is connected with the second electrode of the driving transistor and the first electrode of the light emitting device;

the gate of the fifth switching transistor is connected with the second control line, a first electrode of the fifth switching transistor is connected with the first power supply, and a second electrode of the fifth switching transistor is connected with the first electrode of the driving transistor;

the second electrode of the driving transistor is connected with the first electrode of the light emitting device;

the second electrode of the light emitting device is connected with the second power supply.

In an example, a voltage provided by the first power supply is a reference voltage, the first electrode of the light emitting device is a negative electrode of the light emitting device, and the second electrode of the light emitting device is a positive electrode of the light emitting device;

the second electrode of the driving transistor is connected with the negative electrode of the light emitting device, and the positive electrode of the light emitting device is connected with the second power supply.

In this example, the AMOLED driving circuit further comprises a fourth switching transistor;

a gate of the fourth switching transistor is connected with the first control line, the gate of the fourth switching transistor is connected with the gate of the third switching transistor, a first electrode of the fourth switching transistor is connected with the second electrode of the driving transistor, the second electrode of the third switching transistor and the negative electrode of the light emitting device, a second electrode of the fourth switching transistor is connected with the positive electrode of the light emitting device and the second power supply.

In this example, the first switching transistor, the second switching transistor, the third switching transistor, the fourth switching transistor, the fifth switching transistor and the driving transistor are all N-type thin film transistors.

In another example, a voltage provided by the second power supply is a reference voltage, the first electrode of the light emitting device is a positive electrode of the light emitting device, and the second electrode of the light emitting device is a negative electrode of the light emitting device;

the second electrode of the driving transistor is connected with the positive electrode of the light emitting device, and the negative electrode of the light emitting device is connected with the second power supply.

In the another example, the AMOLED driving circuit further comprises a fourth switching transistor;

a gate of the fourth switching transistor is connected with the first control line and the gate of the third switching transistor, a first electrode of the fourth switching transistor is connected with the second electrode of the driving transistor, the second electrode of the third switching transistor and the positive electrode of the light emitting device, a second electrode of the fourth switching transistor is connected with the negative electrode of the light emitting device, and the second electrode of the fourth switching transistor is connected with the second power supply.

In this another example, the first switching transistor, the second switching transistor, the third switching transistor, the fourth switching transistor, the fifth switching transistor and the driving transistor are all P-type thin film transistors.

In order to achieve above object, in the embodiments of the present disclosure, there is provided an AMOLED display device, comprising: a control unit, a data line driving unit, a first control line, a second control line, a data line and an AMOLED driving circuit, the control unit is used for driving the first control line and the second control line, the data line driving unit is used for driving the data line, and the AMOLED driving circuit is connected with the first control line, the second control line and the data line;

the AMOLED driving circuit utilizes the AMOLED driving circuit described above.

In order to achieve above object, in the embodiments of the present disclosure, there is provided an AMOLED driving method, comprising:

in a first stage, turning on a first switching transistor under the control of a first control line, so that a data line provides a voltage to a capacitor through the first switching transistor;

in a second stage, turning off the first switching transistor under the control of the first control line, and turning off a voltage regulator under the control of the first control line and a second control line, so that the capacitor remains the voltage;

in a third stage, turning off the first switching transistor under the control of the first control line, and controlling a driving transistor to be turned on by the voltage regulator under the control of the first control line and the second control line, so that the driving transistor drives a light emitting device to emit light.

In an example, the voltage regulator comprises a second switching transistor, a third switching transistor and a fifth switching transistor, in the third stage, a voltage provided by the first control line is a low level, and a voltage provided by the second control line is a high level;

wherein said turning off the first switching transistor under the control of the first control line and controlling a driving transistor to be turned on by the voltage regulator under the control of the first control line and the second control line comprises:

turning off the first switching transistor under the control of the low level, turning on the second switching transistor and the fifth switching transistor under the control of the high level, and turning off the third switching transistor under the control of the low level, so as to control the driving transistor to be turned on.

In another example, the voltage regulator comprises a second switching transistor, a third switching transistor and a fifth switching transistor, in the third stage, a voltage provided by the first control line is the high level, and a voltage provided by the second control line is the low level;

wherein said turning off the first switching transistor under the control of the first control line and controlling a driving transistor to be turned on by the voltage regulator under the control of the first control line and the second control line comprises:

turning off the first switching transistor under the control of the high level, turning on the second switching transistor and the fifth switching transistor under the control of the low level, and turning off the third switching transistor under the control of the high level, so as to control the driving transistor to be turned on.

The embodiments of the present disclosure have benefit effects as follows.

In the technical solutions of the AMOLED driving circuit, the AMOLED driving method and the AMOLED display device according to the embodiments of the present disclosure, the AMOLED driving circuit comprises the light emitting device, the first switching transistor, the voltage regulator, the driving transistor and the capacitor, the driving transistor in the AMOLED driving circuit drives the light emitting device to emit light under the control of the voltage regulator, a driving current provided by the driving transistor is independent of Vth of the driving transistor, so that the driving current flowing through the light emitting device is prevented from being affected by the poor uniformity in Vth and the drift of Vth, so that the uniformity in the driving currents flowing through the light emitting devices is enhanced, and thus the uniformity in the brightness of the AMOLED is improved.

DETAILED DESCRIPTION

An AMOLED driving circuit, an AMOLED driving method and an AMOLED display device according to embodiments of the present disclosure will be described in details below in connection with the accompanying drawings, in order to assist those skilled in the art to understand the technical solutions in the embodiments of the present disclosure better. Obviously, the embodiments described below only some embodiments of the present disclosure, but not all embodiments of the present disclosure, other embodiments obtained by those ordinary skilled in the art based on these embodiments without any inventive labors should fall into the protection scope of the present disclosure.

Figure 1:
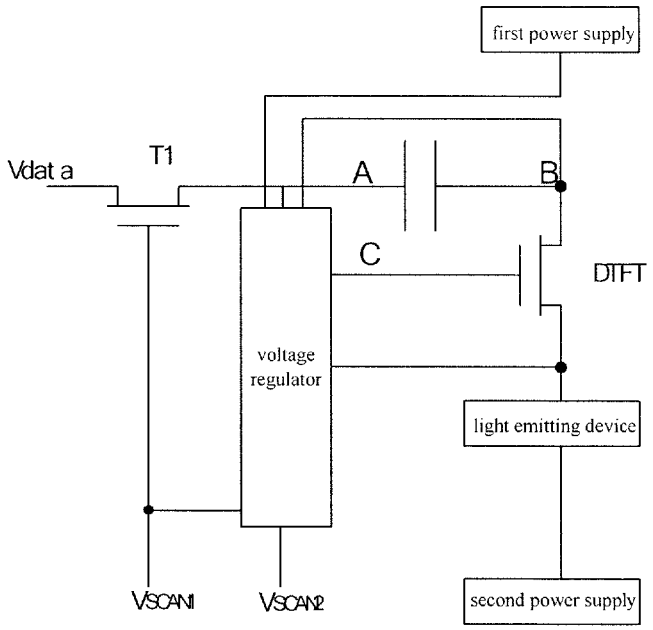
FIG. 1 is a schematic diagram illustrating a structure of an AMOLED driving circuit according to an embodiment 1 of the present disclosure.

FIG. 1 is a schematic diagram illustrating a structure of an AMOLED driving circuit according to an embodiment 1 of the present disclosure. As illustrated in FIG. 1, the AMOLED driving circuit comprises a light emitting device, a first switching transistor T1, a voltage regulator, a driving transistor DTFT and a capacitor Cs. In this embodiment, the light emitting device may be an OLED.

A gate of the first switching transistor T1 is connected with a first control line, a first electrode of the first switching transistor T1 is connected with a data line, and a second electrode of the first switching transistor is connected with the voltage regulator and a first terminal of the capacitor Cs; a first electrode of the driving transistor DTFT is connected with the voltage regulator, the first electrode of the driving transistor DTFT is further connected with a second terminal of the capacitor Cs, a second electrode of the driving transistor is connected with a first electrode of the light emitting device, and a gate of the driving transistor DTFT is connected with the voltage regulator; a second electrode of the light emitting device is connected with a second power supply; the voltage regulator is connected with the first control line, a second control line and a first power supply.

In an example, the second electrode of the driving transistor may be further connected with the voltage regulator.

In an example, a voltage provided by the data line is Vdata, a voltage provided by the first control line is Vscan1, and a voltage provided by the second control line is Vscan2.

In an example, the first switching transistor T1 and the driving transistor DTFT may be N-type thin film transistors, or the first switching transistor T1 and the driving transistor DTFT may be P-type thin film transistors. If the first switching transistor T1 and the driving transistor DTFT are the N-type thin film transistors, a voltage provided by the first power supply is a reference voltage VSS, and a voltage provided by the second power supply is VDD; if the first switching transistor T1 and the driving transistor DTFT are the P-type thin film transistors, a voltage provided by the first power supply is VDD, and a voltage provided by the second power supply is VSS. In the embodiment of the present disclosure, if the voltage provided by the first power supply is the reference voltage, the voltage provided by the second power supply may be higher than the reference voltage correspondingly; if the voltage provided by the second power supply is the reference voltage, the voltage provided by the first power supply may be higher than the reference voltage correspondingly. For example, VDD may be a high level and correspondingly the VSS being the reference voltage may be a low level.

In this embodiment, the voltage regulator is disposed additionally in the AMOLED driving circuit, and the voltage regulator may regulate a gate-source voltage Vgs of the driving transistor DTFT, so that, in the AMOLED driving circuit, a driving current of the driving transistor DTFT in a saturation state is independent of its threshold voltage Vth. In particular, the voltage regulator may cause Vth to be included in a component(s) of Vgs, so that Vth can be cancelled from the driving current $I=K(Vgs-Vth)^2$, and at last the driving current I is independent of the threshold voltage Vth. Wherein the driving transistor DTFT refers to a transistor for providing the driving current to the light emitting device, the threshold voltage refers to the threshold voltage of the driving transistor DTFT, and the gate-source voltage refers to a difference between a gate voltage Vg and a source voltage Vs of the driving transistor DTFT.

The AMOLED driving circuit according to the embodiment of the present disclosure comprises the light emitting device, the first switching transistor, the voltage regulator, the driving transistor and the capacitor, the driving transistor in the AMOLED driving circuit drives the light emitting device to emit light under the control of the voltage regulator, the driving current provided by the driving transistor is independent of Vth of the driving transistor, so that the driving current flowing through the light emitting device is prevented from being affected by the poor uniformity and drift of Vth, the uniformity in the driving currents flowing through the light emitting devices is enhanced, and thus the uniformity in the brightness of the AMOLED is improved. Meanwhile, the current provided by the driving transistor is also independent of a threshold voltage Vth_oled of the light emitting device, so that the driving current is prevented from being affected by a raise in Vth_oled of the light emitting device cause by its deterioration, the uniformity in the driving currents flowing through the light emitting devices is enhanced, and thus the uniformity in the brightness of the AMOLED is further improved. The AMOLED driving circuit in this embodiment also may enhance the reliability of the brightness displayed by the AMOLED and settle the problem of attenuation in the brightness displayed by the AMOLED.

Figure 2:
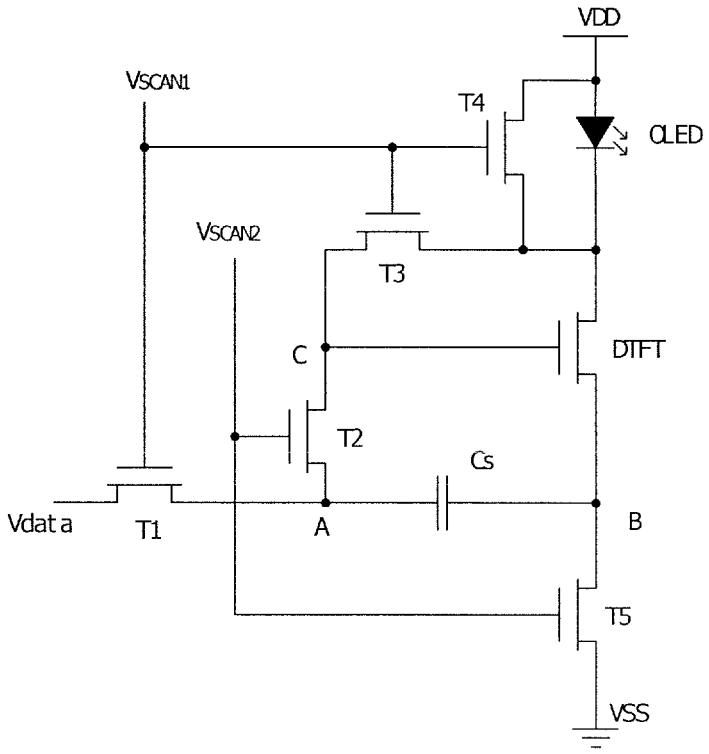
FIG. 2 is a schematic diagram illustrating a structure of an AMOLED driving circuit according to an embodiment 2 of the present disclosure.

FIG. 2 is a schematic diagram illustrating a structure of an AMOLED driving circuit according to an embodiment 2 of the present disclosure. As illustrated in FIG. 2, on a basic of the above embodiment 1, in this embodiment, the voltage regulator comprises a second switching transistor T2, a third switching transistor T3 and a fifth switching transistor T5. In this embodiment, the light emitting device is an OLED.

The second electrode of the first switching transistor T1 is connected with a first electrode of the second switching transistor T2, the second electrode of the first switching transistor T1 is connected with the first terminal of the capacitor Cs; a gate of the second switching transistor T2 is connected with the second control line, the gate of the second switching transistor T2 is connected with a gate of the fifth switching transistor T5, the first electrode of the second switching transistor T2 is connected with the first terminal of the capacitor Cs, the second electrode of the second switching transistor T2 is connected with a first electrode of the third switching transistor T3, and the second electrode of the second switching transistor T2 is connected with the gate of the driving transistor DTFT; a gate of the third switching transistor T3 is connected with the first control line, a first electrode of the third switching transistor T3 is connected with the gate of the driving transistor DTFT, a second electrode of the third switching transistor T3 is connected with the second electrode of the driving transistor DTFT, and the second electrode of the third switching transistor T3 is further connected with a first electrode of the light emitting device; a gate of the fifth switching transistor T5 is connected with the second control line, a first electrode of the fifth switching transistor T5 is connected with the first power supply, and a second electrode of the fifth switching transistor T5 is connected with the first electrode of the driving transistor DTFT; the second electrode of the driving transistor DTFT is connected with the first electrode of the light emitting device; the second electrode of the light emitting device is connected with the second power supply. Wherein a voltage provided by the data line is Vdata, a voltage provided by the first control line is Vscan1, and a voltage provided by the second control line is Vscan2.

In this embodiment, a voltage provided by the first power supply is the reference voltage VSS, a voltage provided by the second power supply is VDD, the first electrode of the light emitting device is a negative electrode of the light emitting device, and the second electrode of the light emitting device is a positive electrode of the light emitting device; the second electrode of the driving transistor DTFT is connected with the negative electrode of the light emitting device, and the positive electrode of the light emitting device is connected with the second power supply.

In an example, the AMOLED driving circuit may further comprise a fourth switching transistor. A gate of the fourth switching transistor T4 is connected with the first control line, the gate of the fourth switching transistor T4 is connected with the gate of the third switching transistor T3, a first electrode of the fourth switching transistor T4 is connected with the second electrode of the driving transistor DTFT, the first electrode of the fourth switching transistor T4 is connected with the second electrode of the third switching transistor T3, the first electrode of the fourth switching transistor T4 is connected with the negative electrode of the light emitting device, a second electrode of the fourth switching transistor T4 is connected with the positive electrode of the light emitting device, and the second electrode of the fourth switching transistor T4 is connected with the second power supply.

The first switching transistor T1, the second switching transistor T2, the third switching transistor T3, the fourth switching transistor T4, the fifth switching transistor T5 and the driving transistor DTFT are all N-type thin film transistors.

Figure 3:
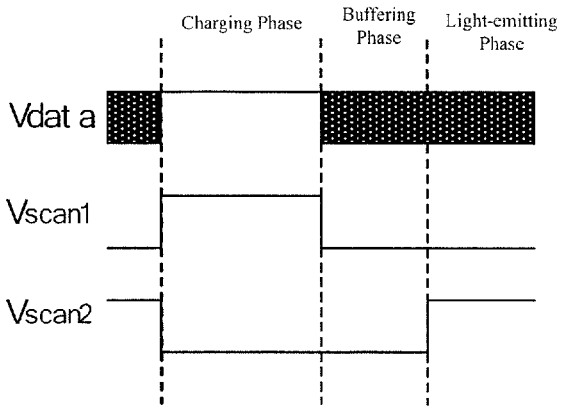
FIG. 3 is a schematic diagram illustrating input voltages of the AMOLED driving circuit in the embodiment 2.
Figure 4:
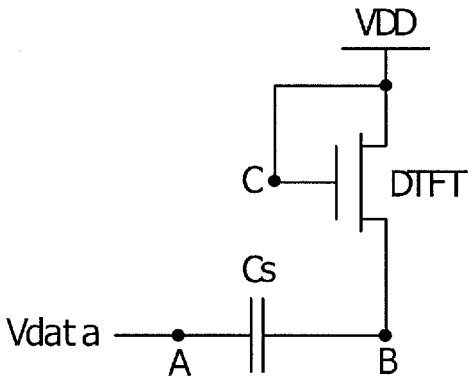
FIG. 4 is a schematic diagram illustrating an equivalent circuit of the AMOLED driving circuit in a charging phase in the embodiment 2.

An operation process of the AMOLED driving circuit in this embodiment will be described in detail below in connection with FIGS. 3-6. FIG. 3 is a schematic diagram illustrating input voltages of the AMOLED driving circuit in the embodiment 2; and FIG. 4 is a schematic diagram illustrating an equivalent circuit of the AMOLED driving circuit in a charging phase in the embodiment 2. As illustrated in FIGS. 3 and 4, in the charging phase, an initial voltage at a point B is VSS, Vscan1 is at the high level, and T1, T3 and T4 are all turned on; Vscan2 is at the low level, T2 and T5 are turned off. As illustrated in FIGS. 2 and 4, paths where T1, T3 and T4 are located respectively are in conduction because T1, T3 and T4 are all turned on, and paths where T2 and T5 are located respectively are not in conduction because T2 and T5 are turned off, so that the equivalent circuit shown in FIG. 4 is formed from the circuit in FIG. 2. The data line inputs a voltage Vdata to the capacitor Cs through T1, the capacitor Cs is charged. At this time, a voltage at a point A is Vdata, the voltage at the point B is VDD−Vth, and a voltage across the capacitor Cs is VCs=VAB=VA−VB=Vdata−VDD+Vth. Wherein VSS is the reference voltage, Vth is the threshold voltage of DTFT. And, as a result of charging the capacitor Cs, the voltage across the capacitor Cs reflects the voltage Vdata provided by the data line and Vth of the driving transistor DTFT.

Figure 5:
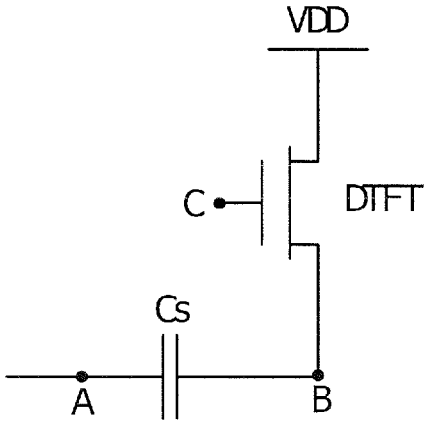
FIG. 5 is a schematic diagram illustrating an equivalent circuit of the AMOLED driving circuit in a buffering phase in the embodiment 2.

FIG. 5 is a schematic diagram illustrating an equivalent circuit of the AMOLED driving circuit in a buffering phase in the embodiment 2. As illustrated in FIGS. 3 and 5, in the buffering phase, Vscan1 is at the low level, Vscan2 is at the low level, and all of T1-T5 are turned off. As illustrated in FIGS. 2 and 5, the paths where T1-T5 are located are all not in conduction, so that the equivalent circuit shown in FIG. 5 is formed from the circuit in FIG. 2. No voltage is input from the data line, the gate of DTFT is floating, the point A of the capacitor Cs is floating, and voltages are input to neither the point A nor the point C. According to a conservation law of charges, both the charges stored in the capacitor Cs and the voltage across the capacitor Cs remain unchanged because no loop for consuming the charges exists in FIG. 5, so that VAB=VCs=Vdata−VDD+Vth.

Figure 6:
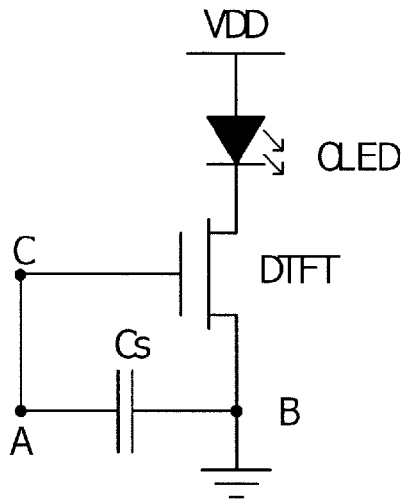
FIG. 6 is a schematic diagram illustrating an equivalent circuit of the AMOLED driving circuit in a light-emitting phase in the embodiment 2.

FIG. 6 is a schematic diagram illustrating an equivalent circuit of the AMOLED driving circuit in a light-emitting phase in the embodiment 2. As illustrated in FIGS. 3 and 6, in the light-emitting phase of the light emitting device, Vscan1 is at the low level, and T1, T3 and T4 are all turned off; Vscan2 is at the high level, and T2 and T5 are turned on. As illustrated in FIGS. 2 and 6, the paths where T1, T3 and T4 are located are not in conduction because T1, T3 and T4 are all turned off, and the paths where T2 and T5 are located are in conduction because T2 and T5 are turned on, so that the equivalent circuit shown in FIG. 6 is formed from the circuit in FIG. 2. At this time, the voltage across the capacitor Cs drives the driving transistor DTFT of the light emitting device to be turned on, so that the light emitting device emits light. In FIG. 6, the point C at the gate of DTFT is directly connected to the point A of the capacitor Cs, then VC=VA, the voltage at the point B is VSS, thus the gate-source voltage Vgs of DTFT is Vgs=VCB=VAB=VCs=Vdata−VDD+Vth (Vdata>VDD). At this time, the driving current flowing through the light emitting device is $I=K(Vgs-Vth)^2=K(Vdata-VDD+Vth-Vth)^2=K(Vdata-VDD)^2$, wherein K=μeff×Cox×(W/L)/2, wherein μeff is the effective carrier mobility in the driving transistor DTFT, Cox is a dielectric constant of a gate insulation layer in the driving transistor DTFT, W/L is a width-length ratio of a channel in the driving transistor DTFT, W is a channel width of the driving transistor DTFT, and L is a channel length of the driving transistor DTFT.

In this embodiment, the capacitor Cs is charged, so that the voltage across the capacitor Cs may reflect the voltage Vdata provided by the data line and Vth of the driving transistor DTFT, that is to say: the voltage across the capacitor Cs is VCs=Vdata−VDD+Vth at the end of the charging phase, and the capacitor Cs then provides the gate-source voltage of DTFT so as to compensate the threshold voltage of DTFT.

In this embodiment, the first electrode and the second electrode of the fourth switching transistor T4 are connected to two electrodes of the light emitting device, respectively. The fourth switching transistor T4 may be used to short-circuit the light emitting device when the driving transistor DTFT generates an incorrect driving current, in order to prevent the light emitting device from emitting light under the incorrect driving current and generating an incorrect luminous intensity, which may lead to display malfunction; further, the fourth switching transistor T4 may connect the light emitting device to the driving transistor DTFT when the driving transistor DTFT generates a correct driving current, so that the light emitting device may emit light under the correct driving current and a normal display may be ensured.

In this embodiment, in order that the driving transistor in the AMOLED driving circuit operates in the saturation state, the AMOLED driving circuit may be configured so that a difference between the gate-source voltage of the driving transistor and the threshold voltage thereof is smaller than or equal to a drain-source voltage thereof, that is, the following equation may be satisfied, Vds≥Vgs−Vth. When the driving transistor operates in the saturation state, the driving current I of the driving transistor only relates to its gate-source voltage Vgs, that is, the following equation may be satisfied, $I=K(Vgs-Vth)^2$, and at this time the gate-source voltage Vgs may be regulated by the voltage regulator, thus a regulation process is simple and convenient because regulation parameters required are less.

The AMOLED driving circuit according to the embodiment of the present disclosure comprises the light emitting device, the first switching transistor, the second switching transistor, the third switching transistor, the fourth switching transistor, the fifth switching transistor, the driving transistor and the capacitor. The driving transistor in the AMOLED driving circuit drives the light emitting device under the control of the second switching transistor, the third switching transistor, the fourth switching transistor and the fifth switching transistor, the driving current provided by the driving transistor is independent of Vth of the driving transistor, so that the driving current flowing through the light emitting device is prevented from being affected by the poor uniformity and the drift of Vth, the uniformity in the driving currents flowing through the light emitting devices is enhanced, and thus the uniformity in the brightness of the AMOLED is improved. Meanwhile, the current provided by the driving transistor is also independent of a threshold voltage Vth_oled of the light emitting device, so that the driving current is prevented from being affected by a raise in Vth_oled of the light emitting device cause by its deterioration, so that the uniformity in the driving currents flowing through the light emitting devices is enhanced, and thus the uniformity in the brightness of the light emitting devices is further improved. The AMOLED driving circuit in this embodiment also may enhance the reliability of the brightness displayed by an AMOLED and settle the problem of attenuation in the brightness displayed by the AMOLED.

Figure 7:
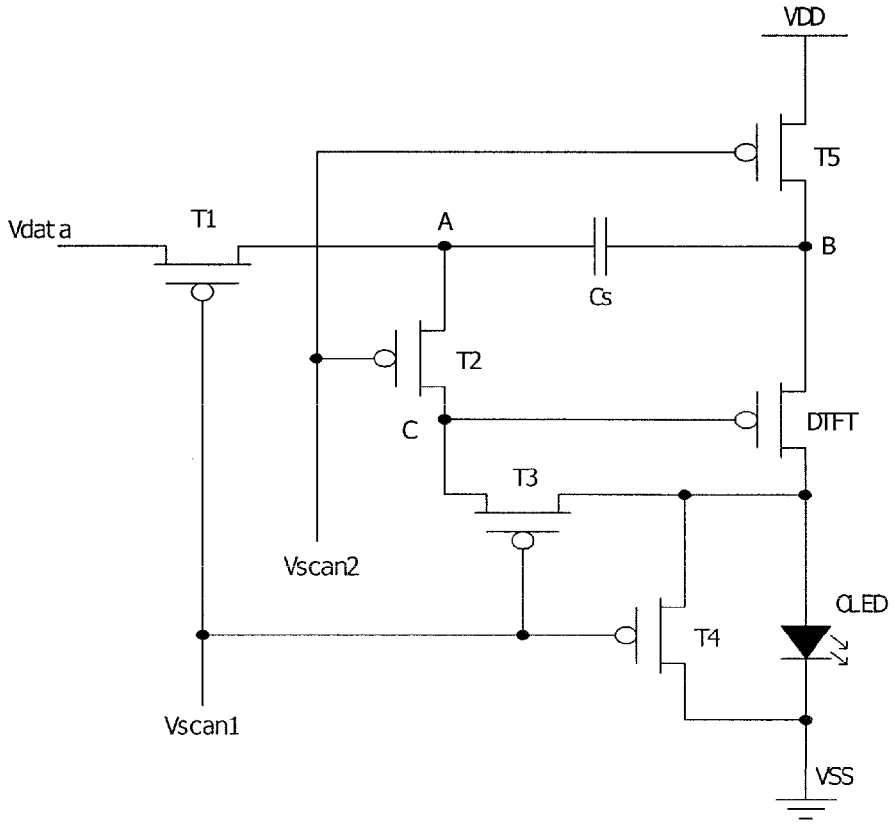
FIG. 7 is a schematic diagram illustrating a structure of an AMOLED driving circuit according to an embodiment 3 of the present disclosure.

FIG. 7 is a schematic diagram illustrating a structure of an AMOLED driving circuit according to an embodiment 3 of the present disclosure. As illustrated in FIG. 7, on a basic of the above embodiment 1, in this embodiment, the voltage regulator of the AMOLED driving circuit comprises a second switching transistor T2, a third switching transistor T3 and a fifth switching transistor T5. In this embodiment, the light emitting device is an OLED The second electrode of the first switching transistor T1 is connected with a first electrode of the second switching transistor T2, the second electrode of the first switching transistor T1 is connected with the first terminal of the capacitor Cs; a gate of the second switching transistor T2 is connected with the second control line, the gate of the second switching transistor T2 is connected with a gate of the fifth switching transistor T5, the first electrode of the second switching transistor T2 is connected with the first terminal of the capacitor Cs, the second electrode of the second switching transistor T2 is connected with a first electrode of the third switching transistor T3, and the second electrode of the second switching transistor T2 is connected with the gate of the driving transistor DTFT; a gate of the third switching transistor T3 is connected with the first control line, the first electrode of the third switching transistor T3 is connected with the gate of the driving transistor DTFT, a second electrode of the third switching transistor T3 is connected with the second electrode of the driving transistor DTFT, and the second electrode of the third switching transistor T3 is connected with the light emitting device; the gate of the fifth switching transistor T5 is connected with the second control line, a first electrode of the fifth switching transistor T5 is connected with the first power supply, and a second electrode of the fifth switching transistor T5 is connected with the first electrode of the driving transistor DTFT; the second electrode of the driving transistor DTFT is connected with the first electrode of the light emitting device; the second electrode of the light emitting device is connected with the second power supply. Wherein a voltage provided by the data line is Vdata, a voltage provided by the first control line is Vscan1, and a voltage provided by the second control line is Vscan2.

In this embodiment, a voltage provided by the first power supply is VDD, a voltage provided by the second power supply is the reference voltage VSS, the first electrode of the light emitting device is a positive electrode of the light emitting device, and the second electrode of the light emitting device is a negative electrode of the light emitting device; the second electrode of the driving transistor DTFT is connected with the positive electrode of the light emitting device, and the negative electrode of the light emitting device is connected with the second power supply.

In an example, the AMOLED driving circuit may further comprise a fourth switching transistor. A gate of the fourth switching transistor T4 is connected with the first control line, the gate of the fourth switching transistor T4 is connected with the gate of the third switching transistor T3, a first electrode of the fourth switching transistor T4 is connected with the second electrode of the driving transistor DTFT, the first electrode of the fourth switching transistor T4 is connected with the second electrode of the third switching transistor T3, the first electrode of the fourth switching transistor T4 is connected with the positive electrode of the light emitting device, a second electrode of the fourth switching transistor T4 is connected with the negative electrode of the light emitting device, and the second electrode of the fourth switching transistor T4 is connected with the second power supply.

The first switching transistor T1, the second switching transistor T2, the third switching transistor T3, the fourth switching transistor T4, the fifth switching transistor T5 and the driving transistor DTFT are all P-type thin film transistors.

Figure 8:
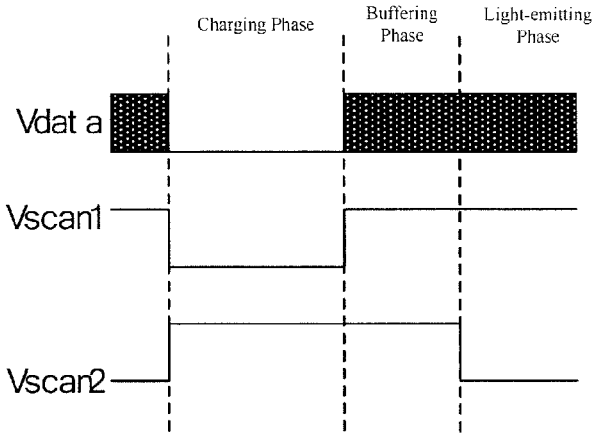
FIG. 8 is a schematic diagram illustrating input voltages of the AMOLED driving circuit in the embodiment 3.
Figure 9:
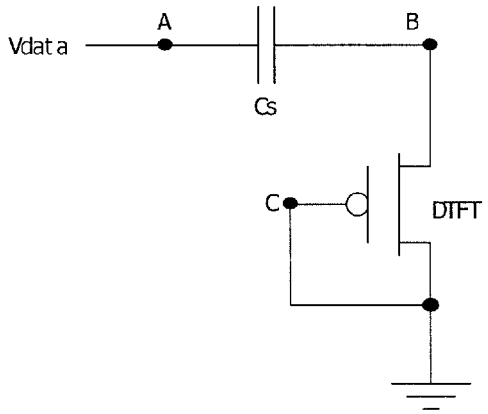
FIG. 9 is a schematic diagram illustrating an equivalent circuit of the AMOLED driving circuit in a charging phase in the embodiment 3.

An operation process of the AMOLED driving circuit in this embodiment will be described in detail below in connection with FIGS. 8-11. FIG. 8 is a schematic diagram illustrating input voltages of the AMOLED driving circuit in the embodiment 3; and FIG. 9 is a schematic diagram illustrating an equivalent circuit of the AMOLED driving circuit in a charging phase in the embodiment 3. As illustrated in FIGS. 8 and 9, in the charging phase, an initial voltage at a point B is VDD, Vscan1 is at the low level, T1, T3 and 14 are all turned on; Vscan2 is at the high level, T2 and T5 are turned off. As illustrated in FIGS. 8 and 9, paths where T1, T3 and T4 are located are in conduction because T1, T3 and T4 are all turned on, and paths where T2 and T5 are located are not in conduction because T2 and T5 are turned off, so that the equivalent circuit shown in FIG. 9 is formed from the circuit in FIG. 8. A data line inputs a voltage Vdata to the capacitor Cs through T1, the capacitor Cs is charged. At this time, a voltage at a point A is Vdata, the voltage at the point B is VSS-Vth, and a voltage across the capacitor Cs is VCs=VAB=VA−VB=Vdata−VSS+Vth. Wherein VSS is the reference voltage, Vth is the threshold voltage of DTFT. And, as a result of charging the capacitor Cs, the voltage across the capacitor Cs reflects the voltage Vdata provided by the data line and Vth of the driving transistor DTFT.

Figure 10:
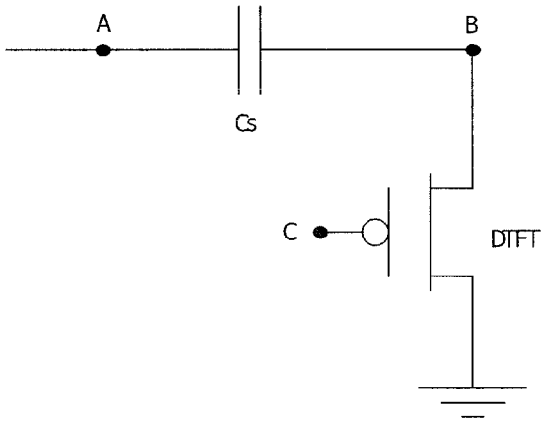
FIG. 10 is a schematic diagram illustrating an equivalent circuit of the AMOLED driving circuit in a buffering phase in the embodiment 3.

FIG. 10 is a schematic diagram illustrating an equivalent circuit of the AMOLED driving circuit in a buffering phase in the embodiment 3. As illustrated in FIGS. 3 and 5, in the buffering phase, Vscan1 is at the high level, Vscan2 is at the high level, and all of T1-T5 are turned off. As illustrated in FIGS. 8 and 10, the paths where T1-T5 are located are all not in conduction, so that the equivalent circuit shown in FIG. 10 is formed from the circuit in FIG. 8. No voltage is input from the data line, the gate of DTFT is floating, the point A of the capacitor Cs is floating, and voltages are input to neither the point A nor the point C. According to the conservation law of charges, both the charges stored in the capacitor Cs and the voltage across the capacitor Cs remain unchanged because no loop for consuming the charges exists in FIG. 10, so that VAB=VCs=Vdata−VSS+Vth.

Figure 11:
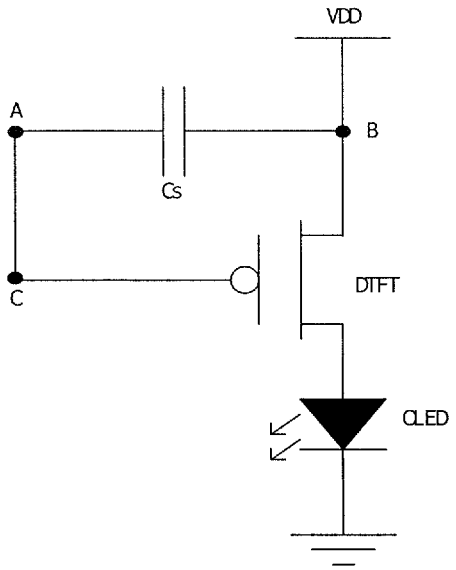
FIG. 11 is a schematic diagram illustrating an equivalent circuit of the AMOLED driving circuit in a light-emitting phase in the embodiment 3.
Figure 12:
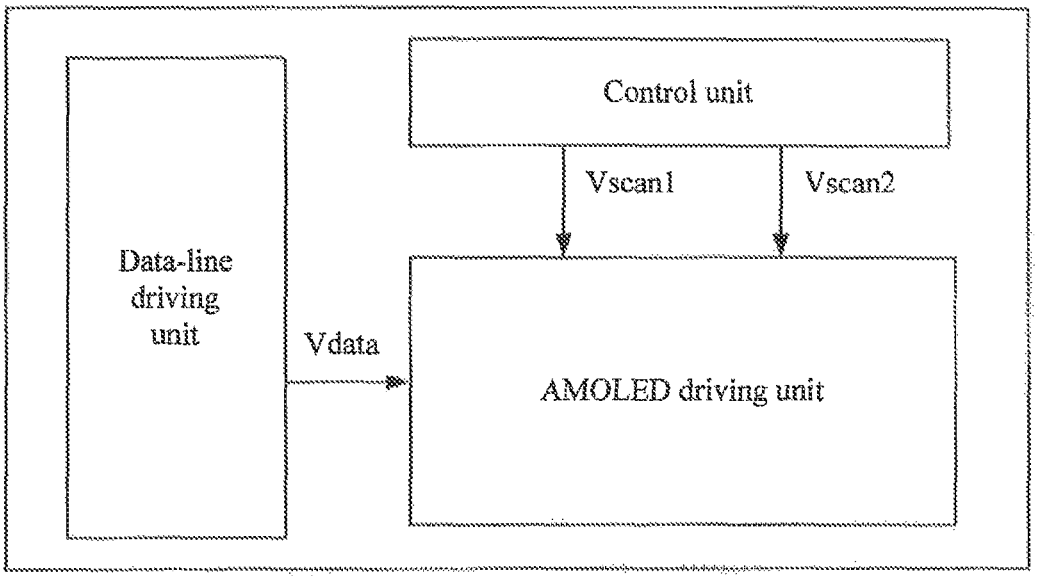
FIG. 12 is a schematic diagram illustrating an AMOLED display device a control unit, Vscan1, Vscan2, Vdata and a data line driving unit.

FIG. 11 is a schematic diagram illustrating an equivalent circuit of the AMOLED driving circuit in a light-emitting phase in the embodiment 3. As illustrated in FIGS. 8 and 11, in the light-emitting phase, Vscan1 is at the high level, and T1, T3 and T4 are all turned off; Vscan2 is at the low level, and T2 and T5 are turned on. As illustrated in FIGS. 8 and 11, the paths where T1, T3 and T4 are located are not in conduction because T1, T3 and T4 are all turned off, and the paths where T2 and T5 are located are in conduction because T2 and T5 are turned on, so that the equivalent circuit shown in FIG. 11 is formed from the circuit in FIG. 8. In FIG. 11, the point C at the gate of DTFT is directly connected to the point A of the capacitor Cs, then VC=VA, the voltage at the point B is VSS, thus the gate-source voltage Vgs of DTFT is Vgs=VCB=VAB=VCs=Vdata−VSS+Vth (Vdata<VSS). At this time, the driving current flowing through the light emitting device is $I=K(Vgs-Vth)^2=K(Vdata-VSS+Vth-Vth)^2=K(Vdata-VSS)^2$, wherein K=μeff×Cox×(W/L)/2.

In this embodiment, the capacitor Cs is charged, so that the voltage across the capacitor Cs may reflect the voltage Vdata provided by the data line and Vth of the driving transistor DTFT, that is to say: the voltage across the capacitor Cs is VCs=Vdata−VSS+Vth at the end of the charging phase, and the capacitor Cs then provides the gate-source voltage to DTFT so as to compensate the threshold voltage of DTFT.

In this embodiment, the first electrode and the second electrode of the fourth switching transistor T4 are connected to two electrodes of the light emitting device, respectively. The fourth switching transistor T4 may be used to short-circuit the light emitting device when the driving transistor DTFT generates an incorrect driving current, so as to prevent the light emitting device from emitting light under the incorrect driving current and generating an incorrect luminous intensity, which may lead to display malfunction; further, the fourth switching transistor T4 may connect the light emitting device to the driving transistor DTFT when the driving transistor DTFT generates a correct driving current, so that the light emitting device may emit light under the correct driving current and a normal display may be ensured.

In this embodiment, in order that the driving transistor in the AMOLED driving circuit operates in the saturation state, the AMOLED driving circuit may be configured so that a difference between the gate-source voltage of the driving transistor and the threshold voltage thereof is smaller than or equal to a drain-source voltage thereof, that is, the following equation may be satisfied, Vds≥Vgs−Vth. When the driving transistor operates in the saturation state, the driving current I of the driving transistor only relates to its gate-source voltage Vgs, that is, the following equation may be satisfied, $I=K(Vgs-Vth)^2$, and at this time the gate-source voltage Vgs may be regulated by the voltage regulator, thus a regulation process is simple and convenient because regulation parameters required are less. Wherein the drain-source voltage refers to a difference between the drain voltage Vd and the source voltage Vs of the driving transistor DTFT.

The AMOLED driving circuit according to the embodiment of the present disclosure comprises the light emitting device, the first switching transistor, the second switching transistor, the third switching transistor, the fourth switching transistor, the fifth switching transistor, the driving transistor and the capacitor. The driving transistor in the AMOLED driving circuit drives the light emitting device under the control of the second switching transistor, the third switching transistor, the fourth switching transistor and the fifth switching transistor, the driving current provided by the driving transistor is independent of Vth of the driving transistor, so that the driving current flowing through the light emitting device is prevented from being affected by the poor uniformity and drift of Vth, the uniformity in the driving currents flowing through the light emitting devices is enhanced, and thus the uniformity in the brightness of the light emitting devices is improved. Meanwhile, the current provided by the driving transistor is also independent of a threshold voltage Vth_oled of the light emitting device, so that the driving current is prevented from being affected by a raise in Vth_oled of the light emitting device cause by its deterioration and drift of Vth, the uniformity in the driving currents flowing through the light emitting devices is enhanced, and thus the uniformity in the brightness of the AMOLED is further improved. The AMOLED driving circuit in this embodiment also may enhance the reliability of the brightness displayed by an AMOLED and settle the problem of attenuation in the brightness displayed by the AMOLED.

The AMOLED driving circuits according to the above embodiments 1-3 are mainly used to drive the AMOLED. It should be noted that the AMOLED driving circuits provided in the above embodiments 1-3 are not only applicable to Poly-silicon thin film transistors but also applicable to other transistors in an actual application.

In embodiments of the present disclosure, the first switching transistor T1, the second switching transistor T2, the third switching transistor T3, the fourth switching transistor T4, the fifth switching transistor T5 and the driving transistor DTFT may be manufactured with the same manufacturing process synchronously, and structures of the manufactured T1, T2, T3, T4, T5 and DTFT may be same, and their differences are only their names.

In the embodiments of the present disclosure, in the respective transistors such as T1, T2, T3, T4, T5 and DTFT, the first electrode and the second electrode function as the source and the drain. In the above transistors, the first electrode and the second electrode have the same structure. In the first electrode and the second electrode, the one transmitting the carriers is the source, and the other receiving the carriers is the drain. In an actual application, depending on the position and function of the transistor in the circuit, the first electrode may be the source and correspondingly the second electrode may be the drain; or, the first electrode may be the drain and correspondingly the second electrode may be the source.

In an embodiment 4 of the present disclosure, there is provided an AMOLED display device, comprising: a control unit, a data line driving unit, a first control line, a second control line, a data line and an AMOLED driving circuit, the control unit is used for driving the first control line and the second control line, the data line driving unit is used for driving the data line, and the AMOLED driving circuit is connected with the first control line, the second control line and the data line. Wherein the AMOLED driving circuit may utilize the AMOLED driving circuit in the embodiment 2 or 3 described above, and details are omitted herein.

In an embodiment 5 of the present disclosure, there is further provided an AMOLED driving method which may be implemented based on an AMOLED driving circuit, and the AMOLED driving circuit may utilize the AMOLED driving circuit in the embodiments described above, and details are omitted herein.

The AMOLED driving method comprises steps as follows.

In step 101, a first switching transistor is turned on under the control of the first control line, so that the data line provides a voltage to a capacitor through the first switching transistor.

In step 102, the first switching transistor is turned off under the control of the first control line, a voltage regulator is turned off under the control of the first control line and the second control line, so that the capacitor remains the voltage.

In step 103, the first switching transistor is turned off under the control of the first control line, the voltage regulator controls a driving transistor to be turned on under the control of the first control line and the second control line, so that the driving transistor drives a light emitting device to emit light.

In an example, the voltage regulator may comprise a second switching transistor, a third switching transistor and a fifth switching transistor. During the step 103, a voltage provided by the first control line is at the low level, and a voltage provided by the second control line is at the high level. The step 103 may comprises detailed operations as follows: the first switching transistor is turned off under the control of the low level, the second switching transistor and the fifth switching transistor are turned on under the control of the high level, and the third switching transistor is turned off under the control of the low level, so as to control the driving transistor to be turned on. This case is the light-emitting phase of the AMOLED driving circuit. Wherein the first switching transistor, the second switching transistor, the third switching transistor, the fifth switching transistor and the driving transistor are the N-type thin film transistors.

In another example, the voltage regulator may comprise a second switching transistor, a third switching transistor and a fifth switching transistor. During the step 103, a voltage provided by the first control line is the high level, and a voltage provided by the second control line is the low level. The step 103 may comprise detailed operations as follows: the first switching transistor is turned off under the control of the high level, the second switching transistor and the fifth switching transistor are turned on under the control of the low level, and the third switching transistor is turned off under the control of the high level, so as to control the driving transistor to be turned on. This case is the light-emitting phase of the AMOLED driving circuit. Wherein the first switching transistor, the second switching transistor, the third switching transistor, the fifth switching transistor and the driving transistor are the P-type thin film transistors.

Further, the AMOLED driving circuit may also comprise a fourth switching transistor.

In an example, the fourth switching transistor is the N-type thin film transistor. During the step 103, a voltage provided by the first control line is at the low level, and a voltage provided by the second control line is at the high level. The step 103 may comprise detailed operations as follows: the first switching transistor is turned off under the control of the low level, the second switching transistor and the fifth switching transistor are turned on under the control of the high level, and the third switching transistor and the fourth switching transistor is turned off under the control of the high level, so as to control the driving transistor to be turned on.

In an example, the fourth switching transistor is the P-type thin film transistor. During the step 103, a voltage provided by the first control line is at the high level, and a voltage provided by the second control line is at the low level. The step 103 may comprise detailed operations as follows: the first switching transistor is turned off under the control of the high level, the second switching transistor and the fifth switching transistor are turned on under the control of the low level, and the third switching transistor and the fourth switching transistor is turned off under the control of the high level, so as to control the driving transistor to be turned on.

The detailed description for the fourth switching transistor may refer to the description for the embodiment of the AMOLED driving circuit, and details are omitted herein.

The AMOLED driving method in this embodiment may be applicable to drive the AMOLED. With the AMOLED driving method, the driving current of the driving transistor in the driving circuit is independent of its threshold voltage in the saturation state. Wherein, the AMOLED driving circuit may comprise the AMOLED driving circuit illustrated in FIG. 1, 2 or 7, but is not limited thereto, and may also comprise other type of driving circuit.

With the AMOLED driving method according to the embodiments of the present disclosure, the driving current provided by the driving transistor is independent of Vth of the driving transistor, therefore the threshold voltage Vth would not affect the current flowing through the light emitting device, so that the driving current flowing through the light emitting device is prevented from being affected by the poor uniformity and drift of Vth, the uniformity in the driving currents flowing through the light emitting devices is enhanced, and thus the uniformity in the brightness of the AMOLED is improved.

It should be noted that the manufacturing processes for the source s and drain g of the above various transistors are the same, and their names may be exchanged depending on a direction of the voltage. Further, the respective transistors in a same pixel circuit may be of a same type or may not be of a same type, as long as, for each transistor in the driving circuit, the timings of the level provided by a gate signal source for turning on the transistor are adjusted according to characteristics of the threshold voltage of the transistor. Of course, preferably, the transistors being turned on by a same gate signal source are of a same type. Even preferably, all transistors in the same pixel circuit are of a same type, and are all N-type thin film transistors or P-type thin film transistors.

It should be clear that the above implementations are only exemplary implementations used to explain the principle of the present disclosure, but the present disclosure is not limited thereto. Those ordinary skilled in the art may make many variations and improvements without departing from a spirit and scope of the present disclosure, and such variations and improvements should also be regarded as falling into the scope sought for protection in the present disclosure.

What is claimed is:

1. An AMOLED driving circuit, comprising:

a light emitting device, a first switching transistor, a second switching transistor, a third switching transistor, a fourth switching transistor, a fifth switching transistor, a voltage regulator, a driving transistor and a capacitor, the first switching transistor, the second switching transistor, the third switching transistor, the fourth switching transistor, the fifth switching transistor and the driving transistor are all N-type thin film transistors, wherein, a gate of the first switching transistor is connected with a first control line, a first electrode of the first switching transistor is connected with a data line, and a second electrode of the first switching transistor is connected with a first terminal of the capacitor;

a gate of the second switching transistor is connected with a second control line, a first electrode of the second switching transistor is connected with the first terminal of the capacitor, a second electrode of the second switching transistor is connected with and a gate of the driving transistor;

a gate of the third switching transistor is connected with the first control line, a first electrode of the third switching transistor is connected with the gate of the driving transistor, a second electrode of the third switching transistor is connected with a second electrode of the driving transistor and negative electrode of the light emitting device;

a gate of the fifth switching transistor is connected with the second control line, a first electrode of the fifth switching transistor is connected with a reference voltage power supply, and a second electrode of the fifth switching transistor is connected with a first electrode of the driving transistor;

the first electrode of the driving transistor is connected with a second terminal of the capacitor, and the second electrode of the driving transistor is connected with the negative electrode of the light emitting device;

a gate of the fourth switching transistor is connected with the first control line, a first electrode of the fourth switching transistor is connected with a positive electrode of the light emitting device, and a second electrode is connected with the negative electrode of the light emitting device, the positive electrode of the light emitting device is connected with a high voltage power supply, and a level of the high voltage power supply is higher than a level of the reference voltage power supply, wherein in a first stage, the first control line is at an active level, the first switching transistor, the third switching transistor and the fourth switching transistor are turned on so that the data line provides a voltage to the capacitor; the second control line is at an inactive level, the second switching transistor and the fifth switching transistor are turned off, such that the first electrode of the capacitor is charged to a voltage at the data line and the second electrode of the capacitor is charged to a voltage equal to the voltage at the high voltage power supply minus a threshold voltage of the driving transistor, wherein the threshold voltage of the driving transistor is bigger than 0;

in a second stage, the first control line is at an inactive level, the first switching transistor, the third switching transistor and the fourth switching transistor are turned off; the second control line is at an inactive level, the second switching transistor and the fifth switching transistor are turned off so that the capacitor remains the voltage; and in a third stage, the first control line is at an inactive level, the first switching transistor, the third switching transistor and the fourth switching transistor are turned off; the second control line is at an active level, the second switching transistor and the fifth switching transistor are turned on so that the driving transistor drives the light emitting device to emit light.

2. The AMOLED driving circuit of claim 1, further comprising a fourth switching transistor;

a gate of the fourth switching transistor is connected with the first control line and the gate of the third switching transistor; a first electrode of the fourth switching transistor is connected with the second electrode of the driving transistor, the second electrode of the third switching transistor and the negative electrode of the light emitting device; and a second electrode of the fourth switching transistor is connected with the positive electrode of the light emitting device and the second power supply.

3. The AMOLED driving circuit of claim 2, wherein the active level of the first control line and the active level of the second control line are a high level, and the inactive level of the first control line and the inactive level of the second control line are a low level.

4. An AMOLED display device, comprising: a control unit, a data line driving unit, a first control line, a second control line, a data line and an AMOLED driving circuit, the control unit is used for driving the first control line and the second control line, the data line driving unit is used for driving the data line, and the AMOLED driving circuit is connected with the first control line, the second control line and the data line;

the AMOLED driving circuit is the AMOLED driving circuit of claim 1.

5. The AMOLED display device of claim 4, further comprising a fourth switching transistor;

a gate of the fourth switching transistor is connected with the first control line and the gate of the third switching transistor; a first electrode of the fourth switching transistor is connected with the second electrode of the driving transistor, the second electrode of the third switching transistor and the negative electrode of the light emitting device; and a second electrode of the fourth switching transistor is connected with the positive electrode of the light emitting device and the second power supply.

6. The AMOLED display device of claim 5, wherein the active level of the first control line and the active level of the second control line are a high level, and the inactive level of the first control line and the inactive level of the second control line are a low level.

* * * * *